United States Patent [19]

Hruda

[11] 4,233,480

[45] Nov. 11, 1980

[54] LOW VOLTAGE VACUUM SWITCH WITH THREE INTERNAL CONTACTS INCLUDING A CENTER FLOATING CONTACT

[75] Inventor: Robert M. Hruda, Horseheads, N.Y.

[73] Assignee: Westinghouse Electric Corp., Pittsburgh, Pa.

[21] Appl. No.: 944,092

[22] Filed: Sep. 20, 1978

[51] Int. Cl.[3] ..... H01H 33/66

[52] U.S. Cl. ..... 200/144 B

[58] Field of Search ..... 200/144 B, 83 C, 83 D

[56] References Cited

U.S. PATENT DOCUMENTS

| | | | |
|---|---|---|---|
| 2,863,026 | 12/1958 | Jennings | 200/144 B |
| 3,405,245 | 10/1968 | Ito et al. | 200/144 B |
| 3,843,856 | 10/1974 | Attia | 200/144 B |
| 4,088,859 | 5/1978 | Hruda | 200/144 B |

FOREIGN PATENT DOCUMENTS

| | | | |
|---|---|---|---|
| 563140 | 11/1932 | Fed. Rep. of Germany | 200/144 B |
| 607604 | 1/1935 | Fed. Rep. of Germany | 200/144 B |
| 1067481 | 5/1967 | United Kingdom | 200/144 B |
| 1093231 | 11/1967 | United Kingdom | 200/144 B |

*Primary Examiner*—James R. Scott

*Attorney, Agent, or Firm*—W. G. Sutcliff

[57] ABSTRACT

A low voltage, high continuous current dc vacuum switch has at least three internal contacts, including an electrically floating center contact and two movable end contacts. The multiple contacts provide electrically serial multiple arc paths so that the switch is operable to interrupt an arc at a dc arc voltage above the arc voltages at which an arc could otherwise be interrupted for a single arc path. Arc shield means are provided to prevent deposition of contact material on predetermined switch envelope internal surfaces.

8 Claims, 3 Drawing Figures

LOW VOLTAGE VACUUM SWITCH WITH THREE INTERNAL CONTACTS INCLUDING A CENTER FLOATING CONTACT

BACKGROUND OF THE INVENTION

The present invention relates to low voltage, high continuous dc current vacuum switches, which are typically used as electrical shunt elements for electrolytic cell chemical processing systems. In such devices a very high continuous dc current at low voltage is passed through the chemical cell to produce the desired chemical components, such as chlorine, sodium hydroxide, or even a refined metal such as copper or aluminum. Such cells are typically used electrically in series, and it is desirable and necessary to be able to isolate or shunt a single cell from the bank of cells for maintenance and/or chemical recharging. A low voltage electrolytic cell shunting switch is seen in U.S. Pat. No. 4,088,859. When such a low voltage vacuum switch is closed, with the contacts in abutting relationship within the vacuum chamber, the current which would otherwise pass through the electrolytic cell is diverted through the vacuum switch which is typically rated at about 6,000 amperes, at up to about 10 volts dc.

The vacuum switch must be effective to interrupt the high amperage current arc which strikes between the contacts as they are opened to divert the current back through the electrolytic cell when it is to be put back into operation. The low voltage dc switch is effective to interrupt this high current arc because a given arc voltage is required to sustain an arc in vacuum for such dc applications. This arc voltage is typically about 20 volts dc and is largely a function of the contact materials, but does not significantly vary for materials such as copper, copperbismuth, or tungsten contacts. The low voltage dc switch with a single arc path is incapable of interrupting operation at dc potentials which exceed the arc voltage. This has limited reliable application of the switch with adequate overvoltage margin to those systems that operate at relatively low dc voltages, typically at about 10 volts or less. There is a class of electrolytic cell that operates at between 20 and 50 volts dc, which is above the arc voltage generally required to sustain a dc arc in vacuum. It has been possible to interrupt such a higher voltage circuit by using several individual low voltage vacuum switches in series. This requires multiple external connections of the switches which can be relatively expensive because of the high continuous dc current carrying capability which the bus connectors must be capable of sustaining. Numerous connections can give rise to high contact resistance which should be avoided.

In ac vacuum interrupters it has been known to employ a multiple-break vacuum-type circuit interrupter as seen in U.S. Pat. No. 3,405,245. An electrically floating center contact was shown in conjunction with a single, or with two movable end contacts to form a multi-break interrupter for the purpose of boosting the withstand voltage capability of the device. An ac vacuum interrupter is effective to interrupt the vacuum arc between the contacts, because the arc current is constantly oscillating and passes through multiple zero current cycles as the contacts are moved apart. At some distance of contact separation, the dielectric strength of the vacuum is sufficient to extinguish the arc, and so long as the withstand voltage for restriking an arc is below an acceptable value, the arc will remain extinguished. This is a different interruption phenomenon than the use of the arc voltage drop in a low voltage dc vacuum switch, since in such switches there is no current oscillation through a current zero.

SUMMARY OF THE INVENTION

A direct current low voltage, high amperage vacuum switch has a low profile, diaphragm end seal construction with an electrically floating central electrical contact and movable end contacts. The vacuum switch of the present invention comprises a hermetically sealed envelope comprised of a central annular insulating portion, opposed thin flexible corrugated annular members extending inward from the central annular insulating portion in a direction transverse to the axis of the central annular insulating portion. A high current carrying movable cylindrical end contact is sealed to the inner annular edge of the thin flexible corrugated annular member at each end of the switch. In the present improved switch a center contact is disposed within the hermetically sealed envelope between the opposed end contacts which are axially movable to and from contact with the center contact. The center contact is supported from the central annular insulating portion of the switch.

In one embodiment of the invention, the support means for the center contact serves as an arcing shield to prevent deposition of vaporized contact material on the interior surface of either the annular insulating portion or on the interior surface of at least one of the thin flexible corrugated annular members.

In another embodiment of the invention arcing shields extend from the cylindrical end contacts to shield the flexible corrugated annular members and the insulating annular portion.

The vacuum switch of the present invention makes use of two electrical series arcing paths within the vacuum switch. This permits interruption of the very high current arc even when the voltage across the switch is above that which would normally be sufficient to sustain the arc in a vacuum between a single pair of contacts.

DESCRIPTION OF THE PREFERRED EMBODIMENTS

Figure 1:
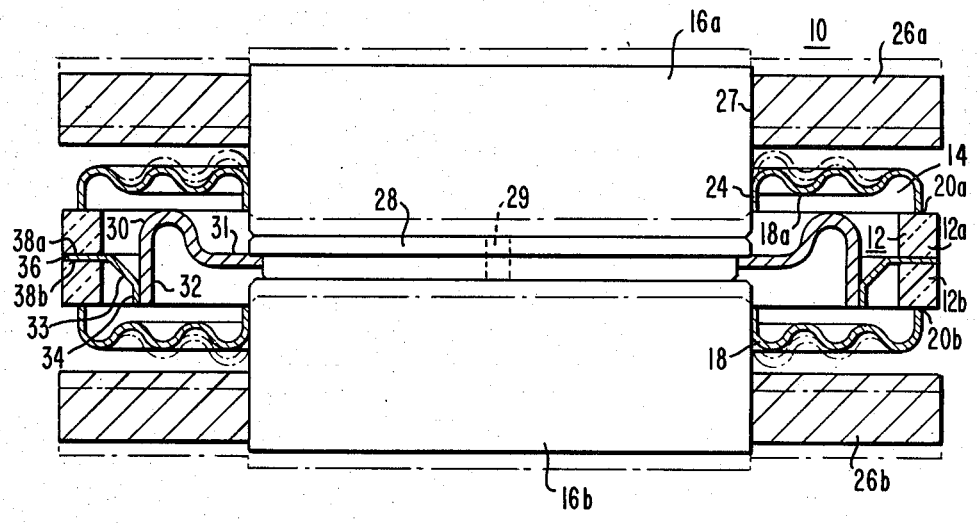
FIG. 1 is an elevational view partly in section of an embodiment of a low voltage switch of the present invention.

In the embodiment of FIG. 1, the low voltage switch includes a central annular insulation portion 12 which in this embodiment is actually a two-piece butted ring-type insulating portion, as will be explained later. A hermetically sealed evacuated chamber 14 is defined by the annular insulating portion 12, opposed cylindrical contact 16*a* and 16*b*, and thin flexible corrugated annular members 18*a* and 18*b*. The outer perimeter of the flexible corrugated members 18*a* and 18*b* is sealed to metallized end surfaces 20*a*, 20*b* of the insulating portion 12. The inner perimeter portion 24 of the flexible corrugated members 18*a* and 18*b* is sealed to the cylindrical contacts 16*a* and 16*b*, respectively. Conductive mounting plates 26*a* and 26*b* are provided with enlarged central apertures 27 through which the cylindrical contacts are received, with the contacts electrically connected to and extending slightly through the mounting plates for external electrical connection to bus conductors from the electrolytic cell. These mounting plates 26*a* and 26*b* facilitate electrical connection of the switch to the bus connections which extend from the electrolytic cell. A plurality of threaded apertures, not shown, are typically provided in the mounting plates to permit bolt-type connection to the conductors.

A centrally disposed stationary center contact member 28, which is electrically floating, is provided within the chamber 14 between the extending ends of the cylindrical contacts 16*a* and 16*b*. The vacuum switch is designed as a normally closed switch with the force of atmospheric pressure forcing the end cylindrical contacts into contact with the electrically floating center contact member 28. Opposed axial forces are applied to the cylindrical end contacts, typically via the mounting plates, to effect movement of the end contacts away from the center contact, and two series arcing paths are established between the end contacts and the center contact. The center contact 28 is supported by an annular support and shield member 30. The annular support and shield member 30 has a general C-shaped cross-section, one end 31 of support and shield member 30 is electrically connected and supports the center contact member 28, while the other end 32 of the annular support member 30 is connected to and supported in turn from a thermally expansive annular support means 33, which is in turn supported from the annular insulating portion 12. The thermally expansive support 33 also has a generally C-shaped cross-section with one end 34 connected to the annular support member 30. The other end 36 of support 33 is brazed between abutted metallized end surfaces 38*a*, 38*b* of two abutted identical annular insulating rings 12*a*, 12*b* which form central annular insulating portion 12.

The electrically floating center contact 28 is typically a planar disk formed of a copper-bismuth contact material, while the two cylindrical end contacts 16*a* and 16*b* are formed of oxygen-free high conductivity copper and have planar end surfaces. The center contact 28 may have a small diameter center aperture 29 therethrough to permit communication within the vacuum chamber 14 on either side of the center contact. The generally C-shaped annular support and shield member 30 is a copper member which also serves as an arcing shield preventing vapor and metal evolved from the contacts from depositing upon the annular insulating portion 12. Conductive deposits on insulating portion 12 could in time form a conductive path rendering the switch inoperative. The thermally expansive shield support 32 is typically formed of Kovar metal, a trademarked material of Westinghouse Electric Corporation.

Figure 2:
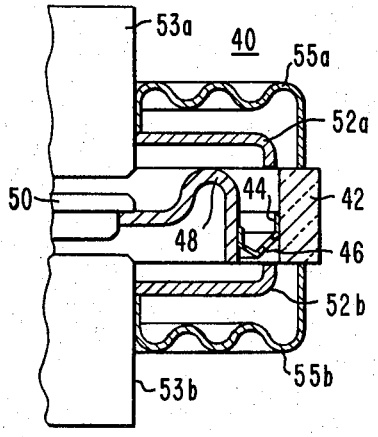
FIG. 2 is a partial elevational view partly in section of another embodiment of a low voltage switch of the present invention in which an alternate center contact support means is utilized, wherein a single piece ceramic annular envelope portion is provided.

In another embodiment of the present invention as seen in the partial view of FIG. 2, the low voltage switch 40 again comprises a three-contact switch with opposed cylindrical end contacts 53*a*, 53*b*, and an electrically floating center contact member 50. In this embodiment a one-piece annular insulating portion 42 is utilized to form the side wall of the switch rather than the two-piece insulating portion 12 seen in the embodiment of FIG. 1. In this embodiment the interior surface 44 of the annular insulating portion 42 is metallized for a short distance to permit brazing of annular arc shield support member 46 thereto to effect physical support of the contact support and arc shield 48 to which support member 46 is connected. The center contact 50 is connected to and supported from contact support and arc shield 48 within the switch. In this embodiment end arcing shields 52*a*, 52*b* extend radially outward from each respective cylindrical end contact 53*a*, 53*b* toward but spaced from the insulating annular portion of the switch to prevent deposition of vaporized contact material on the flexible annular diaphragm members 55*a*, 55*b*. The terminal ends of end shields 52*a*, 52*b* are spaced from but aligned with the central arc shield member 48 to prevent arc vapor generated between the contacts from reaching the thin corrugated flexible members 55*a*, 55*b* and also the annular insulating member 42.

Figure 3:
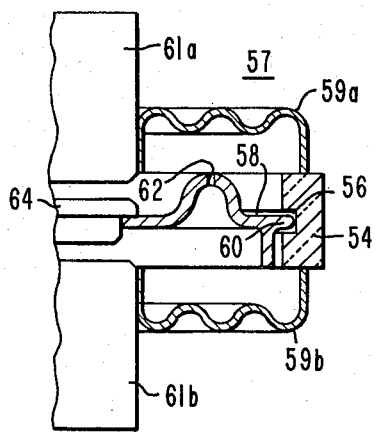
FIG. 3 is a partial elevational view partly in section of another embodiment of the present invention with a modified center contact support means.

In yet another embodiment of the present invention the switch 57 as seen in FIG. 3, has an alternate support system for supporting the center contact. In this embodiment, the annular insulating portion 54 has an annular groove 56 formed or machined on the interior surface. An annular contact support arc shield member 58 is provided with a radially outwardly deformed portion 60 which fits within groove 56 to provide support for the contact support arc shield member 58, and the center contact 64. An aperture 62 is provided through the annular contact support arc shield member for pressure equalization.

While in the embodiments described the support member for the contact support arc shield member has been described as an annular member, it is possible to utilize a plurality of widely spaced-apart support members. In this way there will be ample communication between opposed ends of the evacuated chamber on either side of the center contact to provide equalized pressure within the switch. In a situation where the contact support arc shield member and support member are annular, apertures can be provided through either of these members to permit pressure equalization within the switch as seen in FIG. 3. It is also possible to provide one or more apertures through the center contact typically with the aperture being formed along the central axis of the center contact as seen in the FIG. 1 embodiment. By way of example, a central aperture of about 2 millimeters diameter for a center contact diameter of about 5–6 centimeters has been found to premit pressure equalization on either side of the center contact.

The deformed portion 60 of the support member 58 may be mechanically held in the groove 56, or the groove may be metallized and the deformed portion brazed or welded to the metallized surface of the groove. The annular contact support arc shield member 58 performs the function of protecting the annular insulating member 54 from evolved conductive contact metal which might otherwise be deposited thereon. The shield member 58 also serves to protect the flexible annular diaphragm member 59*a* from the hot evolved vapors or particles which might damage the thin member 59*a*. In this embodiment, switch contact 61*a* should be connected to the more positive potential or anode side of the cell since evolved vapor will tend to be attracted to diaphragm member 59*a*. The opposed contact 61*b* and diaphragm 59*b* are thus connected in the cell circuit to the more negative electrical terminal of the cell.

In each of the embodiments shown, the center contact in the switch is electrically floating and insulated from the end contacts when the end contacts are moved apart to the open switch position. The open contact switch position spacing between the center contact and the end contacts is about ⅛ inch. The center contact has been described as a generally disc-shaped member. The center contact in each embodiment has a stepped periphery portion to facilitate connection to and support by the contact support shield member.

The low dc voltage, high continuous current vacuum switch of the present invention has been rated for continuous operation of 30 volts dc and about 6,000 amperes dc current. For electrolytic cells of higher dc operating voltage, two vacuum switches of the present invention can be electrically series connected as a switch assembly shunting the cell thereby approximately doubling the dc voltage rating for the assembly.

The low dc voltage vacuum switch of the present invention is typically employed with 2 or 3 such switches electrically in parallel with respect to each other as a switch assembly with a common operating mechanism such as described in copending application Ser. No. 915,324. The continuous current rating of the switch or switch assembly is to some extend dependent on the contact resistance between the contacts when they are forced together in the closed switch position, since contact resistance produces heat which must be dissipated. This contact resistance can be minimized by increasing the force applied to the movable end contacts consistent with the cost and complexity of the operating mechanism. The current rating of the switch can also be extending by using cooling means to remove heat generated by the passage of current through the switch.

What we claim is:

1. A direct current, low voltage vacuum switch which is operable to carry a high continuous current of several thousand amperes and to interrupt this arc current formed when the switch contacts are opened at a low dc voltage across the switch which extends the arc voltage above which the arc current would normally be sustained in vacuum between a single pair of spaced apart contacts, which switch comprises a hermetically sealed envelope having a central annular insulating portion, opposed thin flexible corrugated annular members extending inward from the central annular insulating portion in a direction transverse to the axis of the central annular insulating portion, movable high current carrying cylindrical conductive end contacts sealed to the inner annular edge of the thin flexible corrugated annular members, the improvement wherein a center contact is disposed within the hermetically sealed envelope between the opposed end contacts which are axially movable to and from contact with the center contact, which center contact is supported from the central annular insulating portion and electrically isolated from the opposed cylindrical end contacts in the open switch position where the end contacts are moved in opposed axial directions, and wherein the center contact is supported from the annular insulating portion by a central arc shield member disposed about the arc paths between the contacts and the annular insulating portion, with a thermally expansive support means connected between the annular insulating switch portion and the central arc shield member.

2. The direct current, low voltage vacuum switch set forth in claim 1, which has a continuous current rating of about 6,000 amperes at a dc voltage rating of about 30 volts across the switch.

3. The direct current, low voltage vacuum switch set forth in claim 1, wherein an annular end shield extends from at least one cylindrical conductive end contact radially outwardly toward but spaced from the annular insulating switch portion, which end shield is generally parallel to and closely spaced from the flexible corrugated annular member to prevent deposition of arc vapor upon the flexible corrugated annular member.

4. The direct current, low voltage vacuum switch set forth in claim 1, wherein an annular end shield is provided from each cylindrical conductive end contact with the terminal end of the end shield aligned with the central arc shield member to prevent arc vapor from reaching the flexible corrugated annular members at each end of the switch, and also from reaching the central annular insulating portion.

5. The vacuum switch set forth in claim 1, wherein the center contact is a disk-like member with a stepped peripheral portion to which the shield support means is connected.

6. The vacuum switch set forth in claim 1, wherein the center contact has a central aperture through the contact.

7. The vacuum switch set forth in claim 1, wherein the center contact is formed of copper-bismuth contact material, and the cylindrical end contacts are formed of high conductivity copper.

8. The vacuum switch set forth in claim 1, wherein means for communication are provided between the opposed internal portions of the vacuum switch on either side of the center contact to provide uniform vacuum condition throughout the switch volume.

* * * * *